US008100044B1

(12) United States Patent
Teetzel et al.

(10) Patent No.: US 8,100,044 B1
(45) Date of Patent: Jan. 24, 2012

(54) INTEGRATED LASER RANGE FINDER AND SIGHTING ASSEMBLY AND METHOD THEREFOR

(75) Inventors: James W. Teetzel, York, ME (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 154 days.

(21) Appl. No.: 12/506,161

(22) Filed: Jul. 20, 2009

Related U.S. Application Data

(63) Continuation-in-part of application No. 12/185,540, filed on Aug. 4, 2008.

(60) Provisional application No. 61/081,972, filed on Jul. 18, 2008, provisional application No. 60/953,642, filed on Aug. 2, 2007, provisional application No. 61/081,972, filed on Jul. 18, 2008.

(51) Int. Cl.
*F41G 1/473* (2006.01)
*F41G 3/06* (2006.01)
*G06G 7/80* (2006.01)

(52) U.S. Cl. ..... 89/41.17; 235/414

(58) Field of Classification Search ..... 42/114, 42/115, 117, 142; 89/41.17; 235/414, 417
See application file for complete search history.

(56) References Cited

U.S. PATENT DOCUMENTS 4,214,372 A * 7/1980 Rusbach ..... 42/138
4,787,291 A * 11/1988 Frohock, Jr. ..... 89/41.22
4,965,439 A * 10/1990 Moore ..... 235/404
5,052,801 A * 10/1991 Downes et al. ..... 356/153
5,386,308 A * 1/1995 Michel et al. ..... 349/11
5,555,662 A 9/1996 Teetzel
5,659,965 A * 8/1997 Thibodeau et al. ..... 42/126
5,669,174 A 9/1997 Teetzel
5,711,104 A * 1/1998 Schmitz ..... 42/111
5,824,942 A * 10/1998 Mladjan et al. ..... 89/41.17
5,834,676 A * 11/1998 Elliott ..... 89/41.05
5,903,996 A * 5/1999 Morley ..... 42/115
5,922,987 A * 7/1999 Hoffman et al. ..... 89/37.11
5,966,825 A * 10/1999 Biemont ..... 42/136
6,418,657 B1 * 7/2002 Brown ..... 42/124
6,568,118 B1 5/2003 Teetzel
6,899,539 B1 * 5/2005 Stallman et al. ..... 434/11
7,332,682 B2 * 2/2008 Kim ..... 200/18
7,490,430 B2 * 2/2009 Staley, III ..... 42/111
7,621,065 B2 * 11/2009 Gablowski ..... 42/135
2005/0252062 A1 * 11/2005 Scrogin et al. ..... 42/119
2006/0272194 A1 * 12/2006 Guettner ..... 42/122

OTHER PUBLICATIONS

Author Unknown, AR-15-Type Rifle Exploded Diagram, Date Unknown, Published on the internet, "http://www.ar15products.net/att3.gif" converted to Adobe "pdf" file, 2 pages in length.*

* cited by examiner

*Primary Examiner* — Bret Hayes

(74) *Attorney, Agent, or Firm* — McLane, Graf, Raulerson & Middleton, Professional Association

(57) ABSTRACT

An integrated laser range finder and sighting assembly includes a range finder for determining a distance to a target and an onboard ballistics computer for calculating a trajectory and automatically rotating a pointing laser to the proper angle for aligning with a target for firing the weapon.

20 Claims, 14 Drawing Sheets

INTEGRATED LASER RANGE FINDER AND SIGHTING ASSEMBLY AND METHOD THEREFOR

CROSS-REFERENCE TO RELATED APPLICATIONS

This application claim the benefit of priority under 35 U.S.C. §119(e) based on U.S. provisional application No. 61/081,972 filed Jul. 18, 2008.

This application also application claims priority under 35 U.S.C. §120 to U.S. application Ser. No. 12/185,540 filed Aug. 4, 2008, which, in turn, claims the benefit of priority under 35 U.S.C. §119(e) to U.S. provisional application No. 60/953,642 filed Aug. 2, 2007, and U.S. provisional application No. 61/081,972, filed Jul. 18, 2008. Each of the aforementioned applications is incorporated herein by reference in its entirety.

BACKGROUND

This application discloses further improvements on the laser range finding and sighting apparatuses disclosed in the aforementioned U.S. application Ser. No. 12/185,540 and U.S. provisional patent application Nos. 60/953,642 and 61/081,972, the laser range finding apparatuses disclosed in U.S. Pat. Nos. 5,555,662 and 5,669,174, and the grenade launcher sighting assembly disclosed in U.S. Pat. No. 6,568,118. Each of the aforementioned patents is incorporated herein by reference in its entirety.

SUMMARY

The present disclosure relates to an integrated rangefinder and sight with ballistic computer for use with firearms. In further embodiments, a second, auxiliary sight, such as a reflex sight may be provided. It will be recognized that the present development is not limited to use with firearms of any particular type, size, munitions type, or caliber. The present disclosure will be made herein primarily by way of reference to the preferred embodiment wherein the firearm is a grenade launcher, such as a stand alone grenade launcher or grenade launcher that is attachable to a military or assault rifle such as an M-16 assault rifle, M-4 Carbine, or the like. Further, the present development is particularly advantageous for use with firearms or artillery that launches or fires projectiles at relatively high elevation angles. However, the present development is not limited to such and can be used with any type of firearm or artillery that launches a projectile with a known trajectory. The terms "firearm" and "artillery" as used herein are intended to encompass all manner of weaponry, including without limitation, guns such as handguns and rifles, heavy caliber guns, grenade launchers, cannons, howitzers, mortars, rocket launchers, and the like.

BRIEF DESCRIPTION OF DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
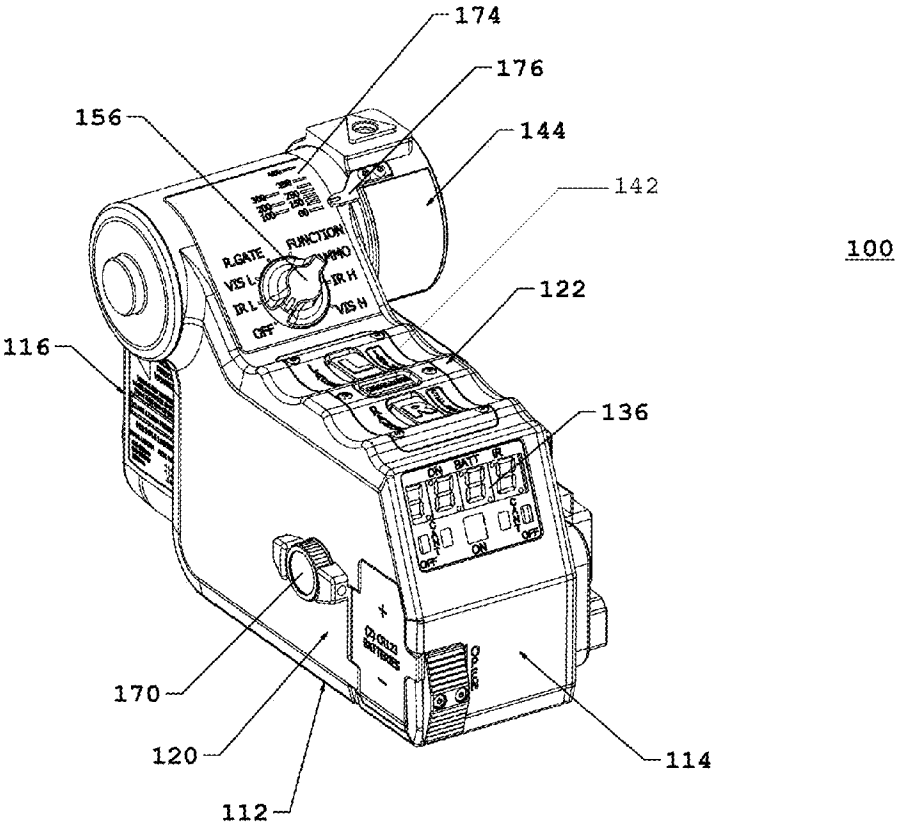
FIG. 1 is a pictorial view, taken generally from the rear and left side, of a first exemplary embodiment of a sight unit herein.

Referring to the drawings wherein like reference numerals refer to like or analogous components throughout the several views, an exemplary sight module 100 is shown, which includes a housing 112. As used herein, terms denoting direction or orientation, such as left, right, front, rear, upper, lower, horizontal, vertical, etc., are taken from the perspective of an operator facing a rear side 114 of the unit 100 when the unit is mounted on a weapon, such as directly to a grenade launcher or other weapon capable of use in stand alone fashion or to a firearm such as a military rifle carrying a grenade launcher module. A left side 120 of the unit 100 is disposed opposite a right side 118 thereof. Opposite upper and lower surfaces 122 and 124, respectively, are bounded by the generally vertically-extending (in the orientation shown in FIG. 1) front, rear, left and right surfaces 116, 114, 120, and 118, respectively.

Figure 2:
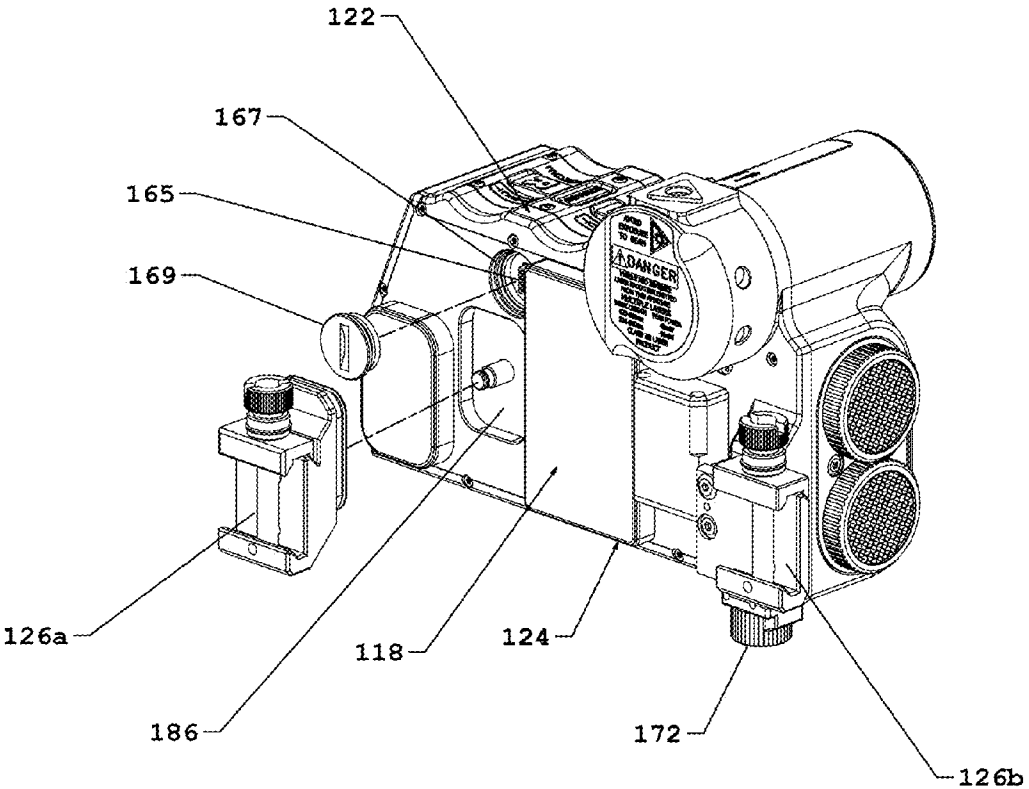
FIG. 2 is a partially exploded pictorial view, taken generally from the front and right side, of the embodiment shown in FIG. 1.
Figure 3:
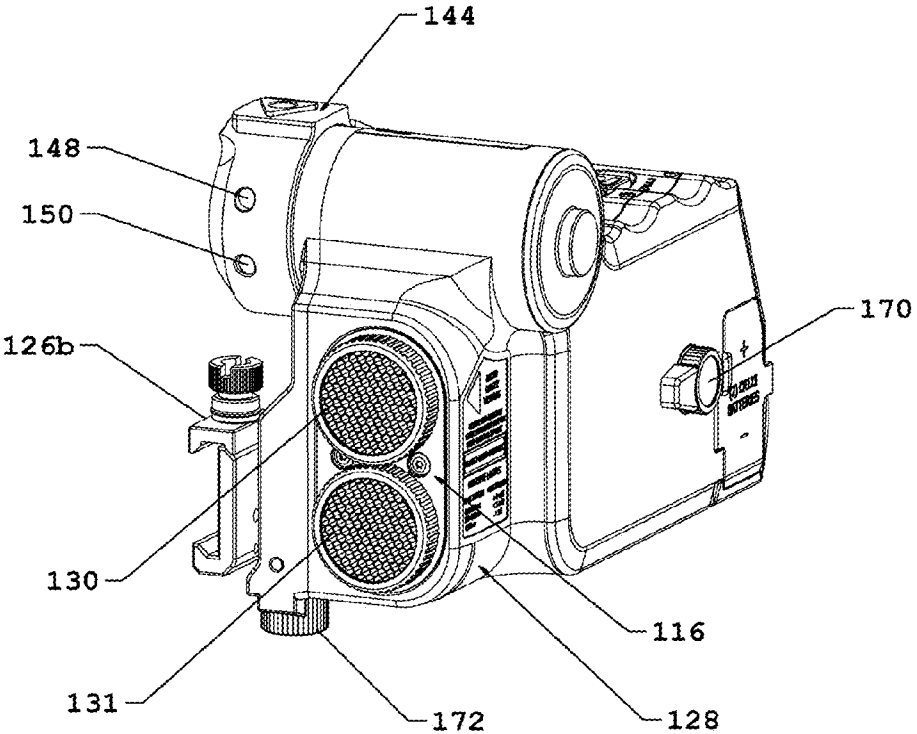
FIG. 3 is a pictorial view, taken generally from the front and left side, of the embodiment shown in FIG. 1.
Figure 7:
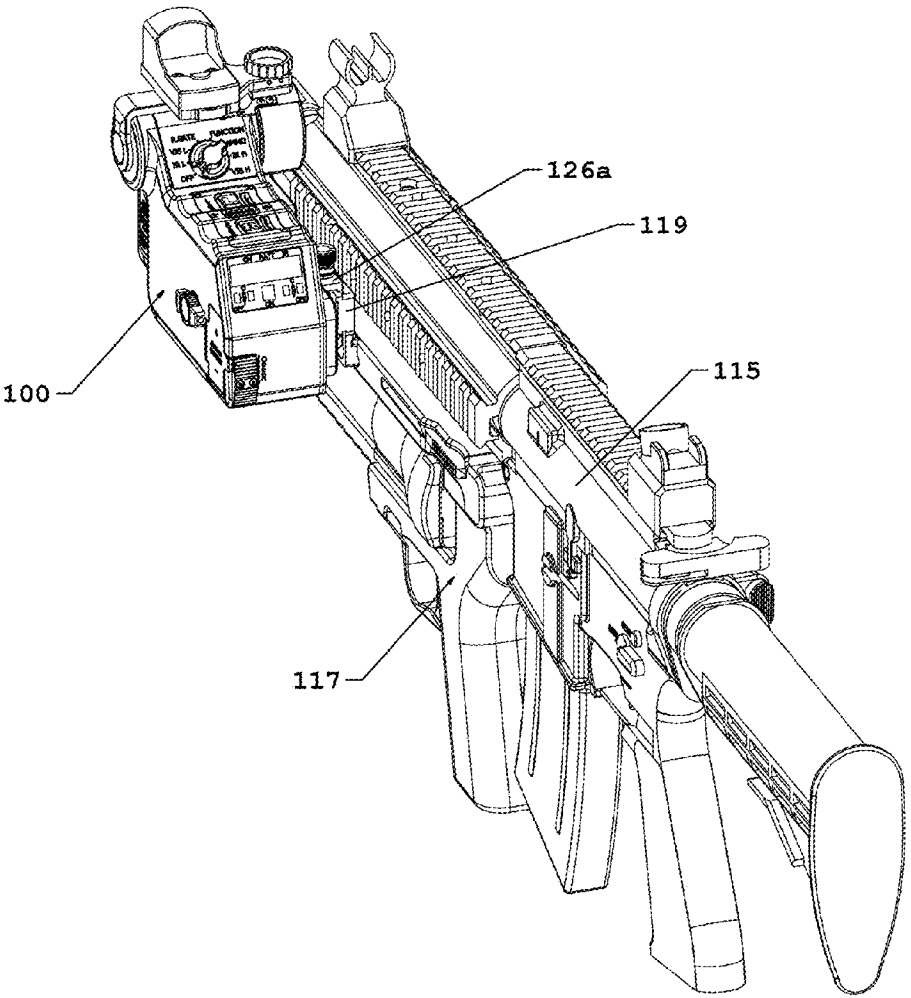
FIG. 7 is a pictorial view of the embodiment shown in FIG. 1, shown attached to a left side Picatinny interface of a grenade launcher, and wherein the grenade launcher is attached to a bottom rail interface of a military rifle.
Figure 8:
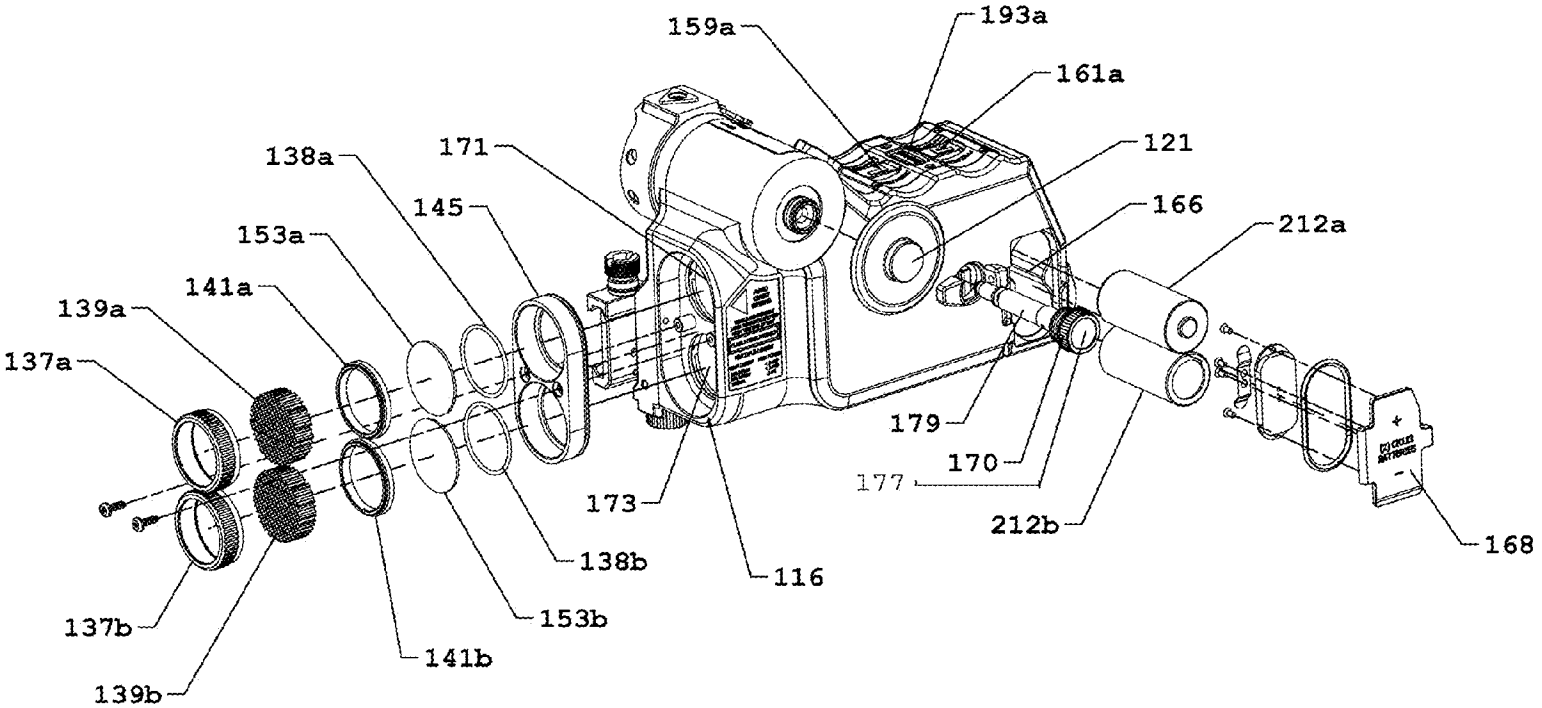
FIG. 8 is a partially exploded pictorial view of the embodiment shown in FIG. 1, taken generally from the front, above, and to the left.

In operation, the user views the rear side 114 of the unit 100. The front side 116, as best seen in FIGS. 3 and 8, is opposite the rear surface 114 and faces away from the user during operation, toward the selected target. The right side 118 (see FIG. 2), is adapted to be attached to the left side of a weapon 115, such as a military rifle having a grenade launcher 117 attached thereto (see FIG. 7). It will be recognized that other mounting configurations are possible and the unit 100 may be adapted to the type or types of firearm or artillery with which the unit 100 is to be used.

In the illustrated embodiment, the right side 118 of the unit 100 includes first and second rail grabbers 126*a* and 126*b*. In the depicted embodiment, the rail grabbers 126*a* and 126*b* are adapted to fasten the unit 100 to a conventional Picatinny (e.g., MIL-STD-1913) mounting rail 119 on the left side of the weapon 115. It will be recognized that the rail grabbers 126*a* and 126*b* could be adapted for use with other rail or accessory mounting interfaces. The grenade launcher 117 may be an XM320 grenade launcher module or the like.

Alternatively, a section of Picatinny mounting rail 119 (or other interface type if desired) may be removably attached to the grenade launcher 117 left or right rail interface surfaces, which allows the unit 100 to be removably attached to a complimentary rail interface member 119 or 181 enabling use with a grenade launcher 117, e.g., of a type capable of being used as a stand alone unit.

Referring now to the front side 116, the unit 100 includes an optical range finder 128 including an optical transmitter 130 with an optical source, such as a laser and preferably an infrared (IR) laser source, and an optical receiver 131. In operation, the distance to a target is determined by measuring the time interval between the emission of an optical signal by the transmitter 130 to the target and detection of the reflected signal by the receiver 131. The range finder assembly 128 may be a commercially available unit, such as a rangefinder unit available, for example, from Vectronix Inc. of Leesburg, Va.

The front side 116 of the housing 112 includes removable rings 137*a* and 137*b*, containing an anti-glare member formed of a honeycomb or other collimating material 139*a* and 139*b* to prevent off-angle reflections from the range finder components. Optical lenses 153*a* and 153*b*, which permit passage of the wavelength of the optical source 130, may be provided in the apertures 171 and 173 and may include a sealing ring 138*a* and 138*b* or gasket thereabout to prevent entry of moisture and environmental contamination into the interior of the housing 112 through the apertures 171, 173. Retaining rings 141*a* and 141*b* secure the optical lenses 153*a* and 153*b* into a housing member 145. Optionally, one or more other optical elements may be aligned with the optical axes of the laser elements in the range-finding laser unit 130.

Figure 9:
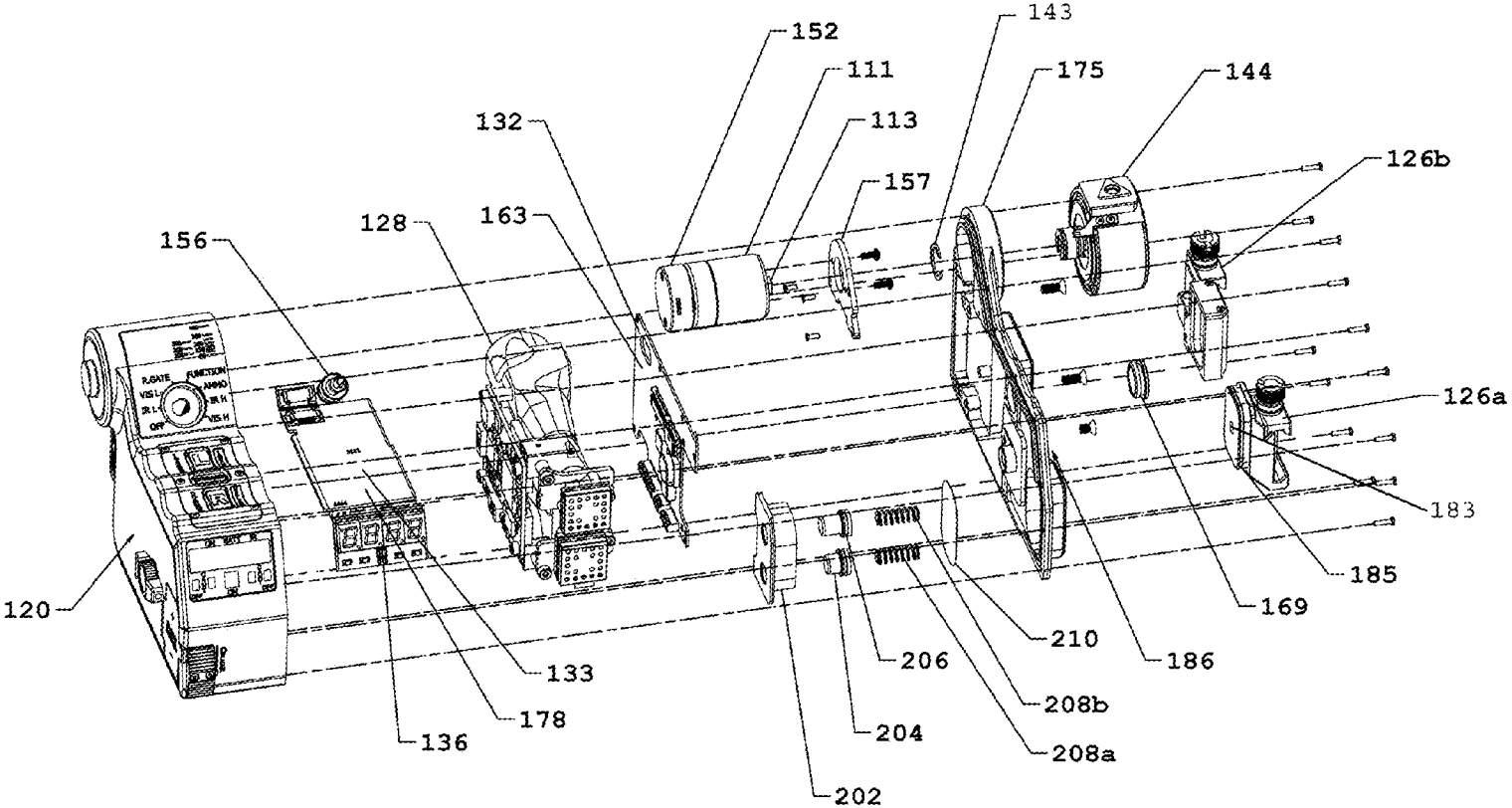
FIG. 9 is a partially exploded pictorial view, taken generally from above and from the rear, of the embodiment shown in FIG. 1.
Figure 11:
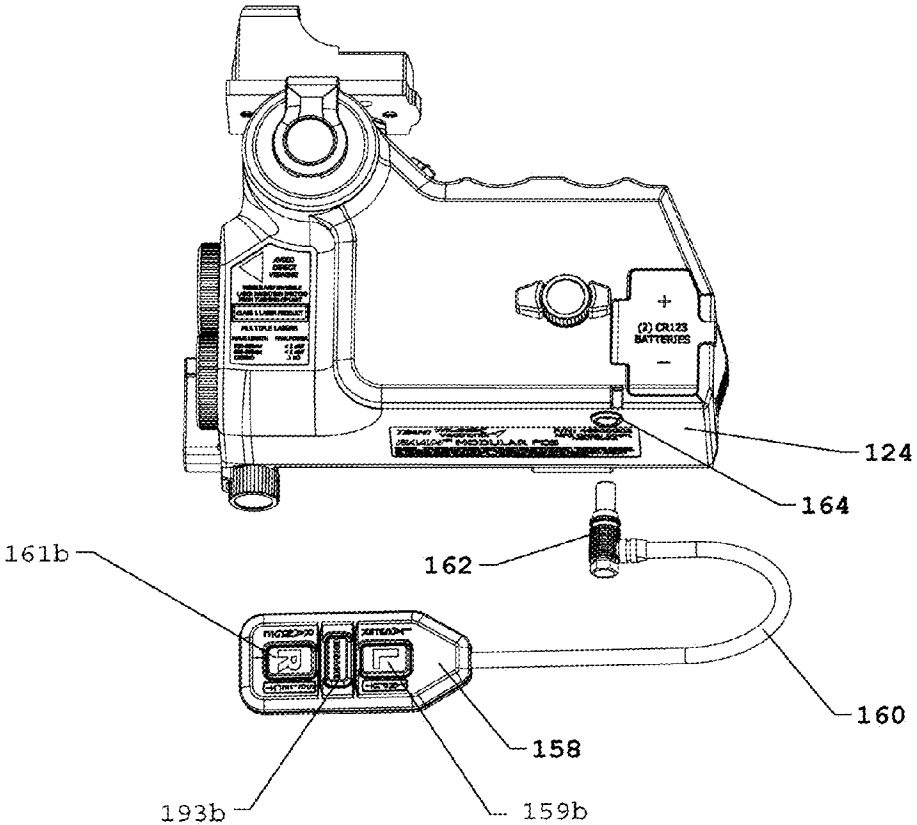
FIG. 11 is a pictorial view taken generally from below and to the left, of the embodiment shown in FIG. 1 with the remote control unit.

As best seen in FIGS. 9 and 11, the range calculation is performed by an onboard processor, microprocessor, microcontroller, or the like 132, which may be coupled to the rangefinder 128 and other on-board components as described herein via a data bus 134. The processor 132 is provided on a main processing board 163. The processor 132 is also electrically connected to a programming port 165 for programming the processor with software instructions to perform the ballistic computations and other functions of the unit 100 and/or for storing software instructions in a memory 155 of, or coupled to, the processor 132. The port 165 is accessible through an opening 167 in a right side housing cover 175. The opening 167 is covered with a removable cover 169, which may include an O-ring or the like to prevent entry of moisture or other external contaminants into the housing 112.

The distance to the target as determined by the rangefinder 128 may be output to a human viewable display 136 located on the rear facing surface 114 via the data bus 134. The display unit 136 may be any display type and is preferably a light emitting diode (LED) display or liquid crystal display (LCD). Advantageously, the display may be a seven-segment LED or LCD display of a type used to display alphanumeric characters, and may be a backlit LCD display.

Figure 5:
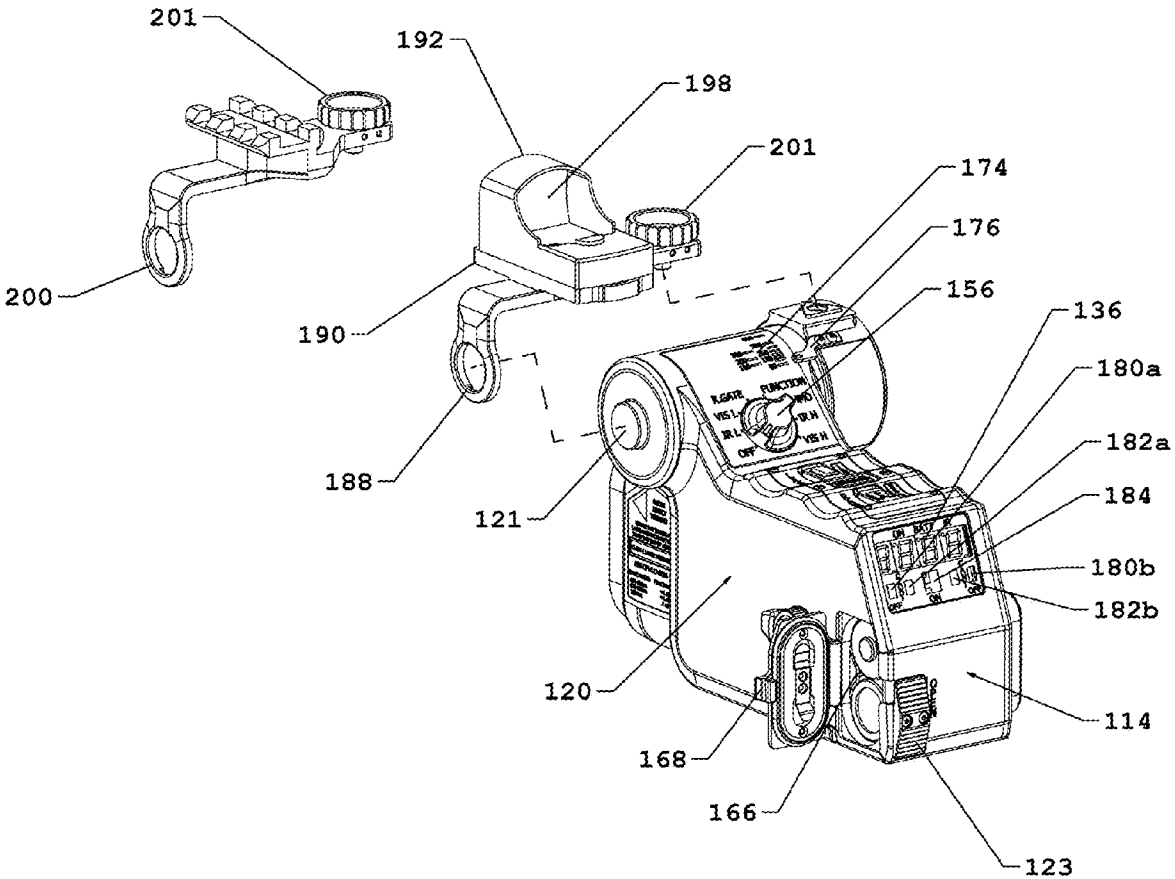
FIG. 5 is a partially exploded, pictorial view, taken generally from the rear and left side, of the embodiment shown in FIG. 1, and wherein an optional auxiliary sighting device is attached via an adapter plate to the upper surface of the sight unit.
Figure 6:
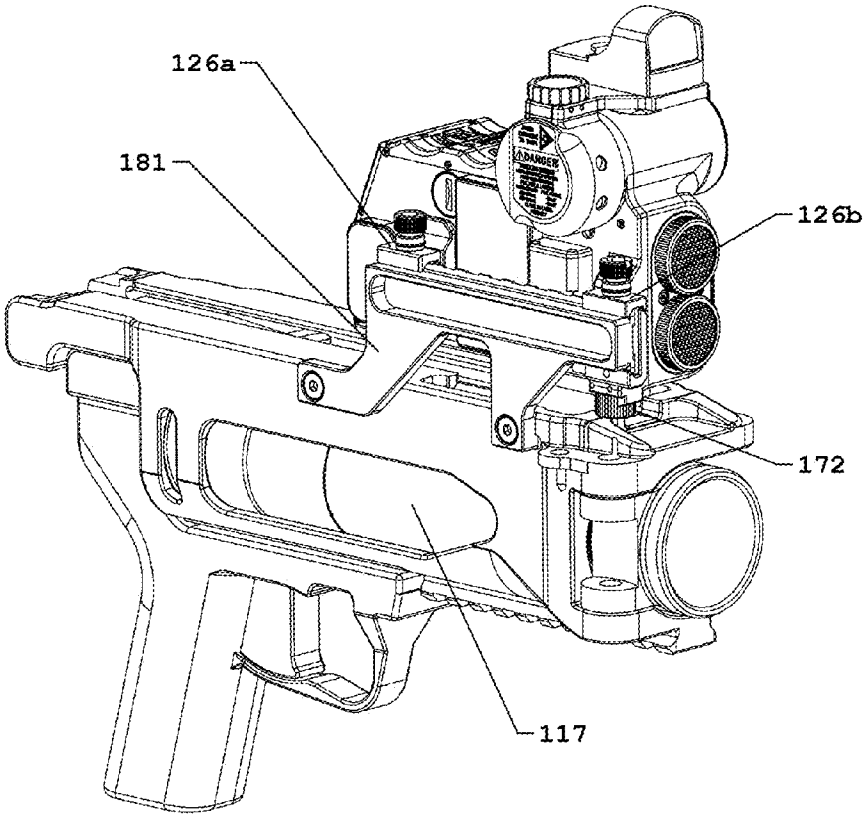
FIG. 6 is a pictorial view of the embodiment shown in FIG. 1, shown attached directly to a grenade launcher that is adapted to be used as a stand alone unit.

As best seen in FIG. 5, an optional auxiliary sight 192 is removably coupled to the pointing laser assembly 144 via an optical sight attachment knob 201 and optical sight pivot post 121 of the housing 112. The auxiliary sight 192 may be used in the conventional fashion and may advantageously be employed in the event that the unit 100 malfunctions. The auxiliary sight 192 is also advantageously employed if the laser spot created by laser pointer sight is not readily visible, e.g., under bright light conditions. The optional auxiliary sight 192 is described in greater detail below.

In the depicted preferred embodiment, a pointing laser assembly 144 includes a rotatable knob 146 portion, a main housing portion 147, and a laser housing rear cover 149, which house a first pointing laser 148 and a second pointing laser 150. The main laser housing 147 includes apertures 151*a* and 151*b* aligned with each of the lasers 148 and 150, respectively. The pointing laser assembly 144 is coupled to a controller 152, such as a servomotor or drive motor for controlling the degree of rotation of the laser assembly 144 relative to the axis of the barrel of the weapon. The controller 152 may use gears and/or other conventional mechanical linkages to rotate the laser assembly 144 as would be understood by persons skilled in the art. In the depicted preferred embodiment, a drive motor 111 rotates a drive shaft 113, which is coupled to a shaft 135 on the housing portion 147 to rotate the laser assembly 144 to a desired angular position. The pointing laser assembly 144 is secured to the right side housing cover 175 via retaining ring 143 and the drive shaft 113 is secured to the interior of housing cover 175 via motor mount 157 enabling laser assembly 144 to be controlled by controller 152.

Figure 4:
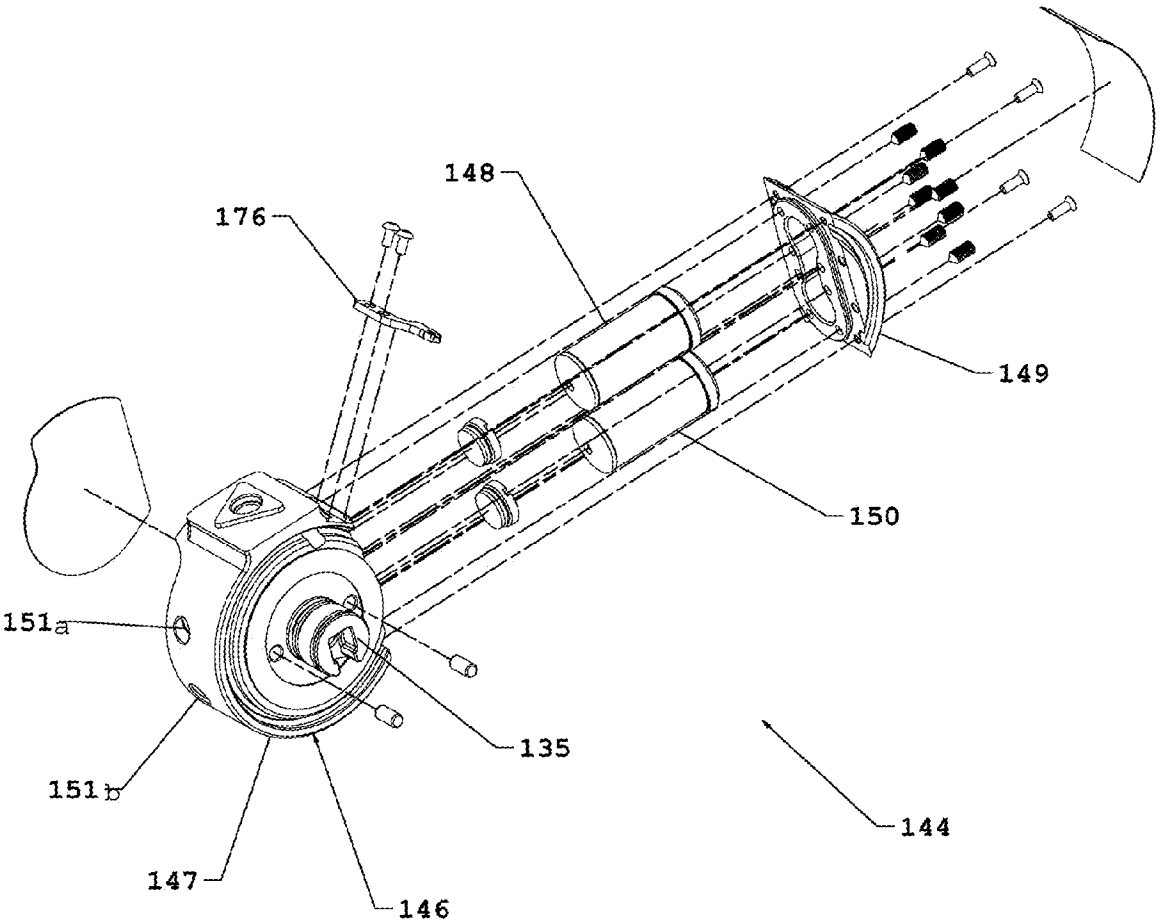
FIG. 4 is a partially exploded view of the pointing laser assembly.

Although the use of only a single pointing laser is contemplated, a plurality of user selectable pointing lasers may be provided, e.g., so that lasers having different wavelengths may be selectively employed. The depicted preferred embodiment includes first and second pointing lasers 148, 150. For example, the pointing laser 148 may be an infrared laser for use with night vision goggles and the laser 150 may be visible laser for viewing with the naked eye. The pointing laser to be used to sight onto a specific target may be user selectable as described below. The lasers 148 and 150 are transmitted through the apertures 151*a* and 151*b* in the main laser housing 147. Although the pointer lasers 148 and 150 are displaced on the laser assembly 144, as best seen in FIG. 4, they are preferably aligned and rotate together in parallel fashion so that the beams emitted by each are parallel to each other.

A power switch 156 on the upper surface 122 is provided to power the unit on and off and preferably is a rotary switch to allow the selection from among multiple pointing laser modes. For example, in the depicted preferred embodiment wherein multiple pointing lasers are provided, the switch 156 could be rotatable to select between OFF, IR LOW, IR HIGH, VIS. LOW, and VIS. HIGH positions, wherein the IR positions will select the infrared pointing laser 148 and the VIS positions will select the visible laser 150 and the IR HIGH and VIS. HIGH positions will select a high power setting while the IR LOW and VIS. LOW positions will select a low power setting. As in the depicted preferred embodiment, the switch 156 may also contain additional selections for available functions, ammunition, and setting a minimum range gate. Indicia representative of the mode corresponding to each rotational position of the switch 156 may be provided on the housing 112 as depicted in the preferred embodiment. In alternative embodiments, a single pointing laser and/or a single power setting for each laser may be provided. An option to deactivate both pointing lasers may also be provided for use of the unit with an alternative or auxiliary sighting device 192, as described below. Other switching configurations are also contemplated.

Other functions may also be controlled via the selector 156. For example, a display setting, e.g., DIS, may be provided for the selector 156 which allows the user to control display functions, such as brightness in the case of an LED display, or brightness and/or contrast in the case of an LCD display. Similarly, a weapon selection setting may be provided where trajectory data is provided for multiple types of firearms, as described below.

Figure 10:
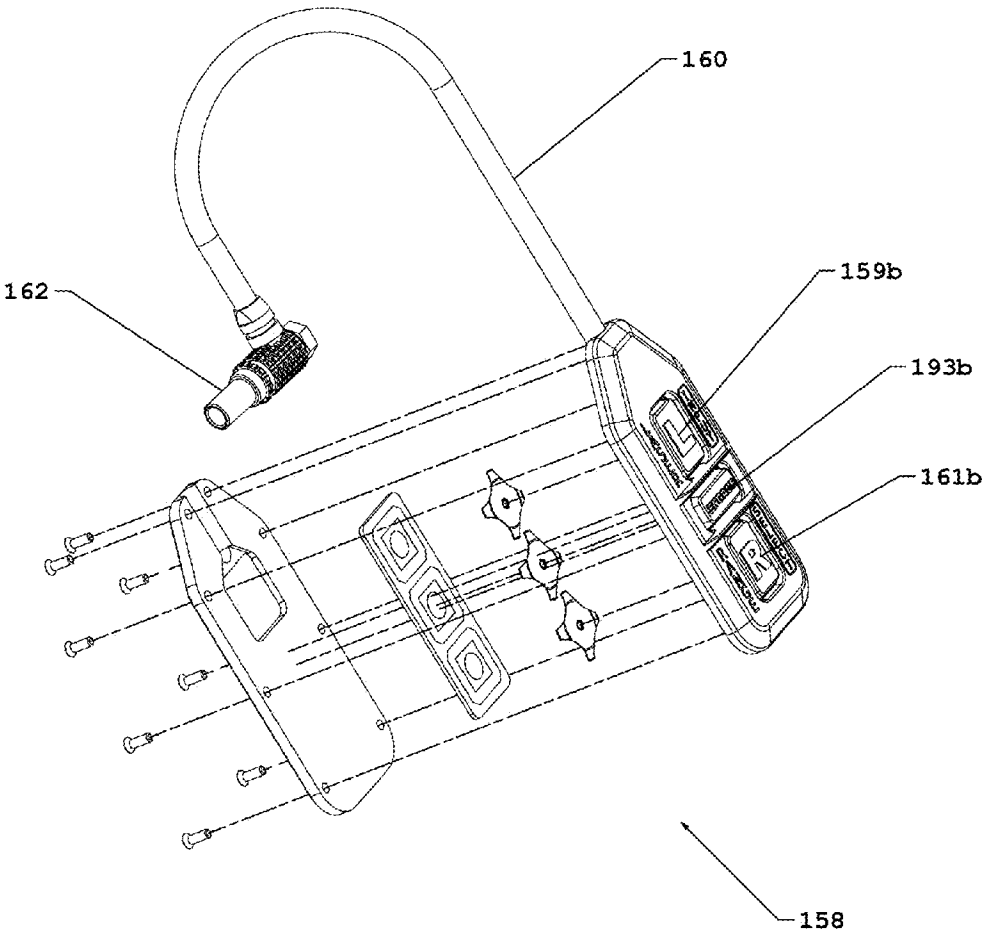
FIG. 10 is a partially exploded pictorial view, showing the remote control button switches.

Operation of the unit may be controlled using the first control pad 142 or a second control pad 158 including, for example, a first switch 159*a* and 159*b* for controlling the pointing lasers 148, 150, a second switch 161*a* and 161*b* for controlling the range finder 128, and a third switch 193*a* and 193*b* for activating the motor to set the proscribed trajectory of the weapon. The selector switch 156 and first control pad 142 are located on the upper surface of the sight, while a second control pad 158 is coupled to the unit 100, e.g., via a cable 160 and plug connector 162 engaging a receptacle 164 on the lower surface 124 of the unit, as best seen in FIG. 11, which, in turn, is coupled to the processor 132 via the data bus 134. An exploded view of the control pad 158 appears in FIG. 10.

Power is supplied to the processor 132, the display 136, the range finder 128, the pointing lasers 148, 150, and the controller 152 via one or more batteries or battery packs, e.g., one or more lithium batteries 212*a* and 212*b*, housed in a battery compartment or tube 166, e.g., having a removable cover or sealed, hinged door 168 with a sliding lock 123. Power is transferred from batteries 212*a* and 212*b* through power contact housing 202 to power contact insulator 210 via positive power contact 204, negative power contact 206 and contact springs 208*a* and 208*b*.

A windage adjustment knob 170 is disposed on the left side 120 of the unit to provide a horizontal bore sighting adjustment for bore sighting the pointing lasers 148, 150 to the weapon. An elevation adjustment knob 172 is provided on the lower surface 112 of the unit to provide a vertical bore sighting adjustment of the pointing lasers to the weapon.

The windage knob 170 includes a manually rotatable knob portion or head portion 177, and a threaded rod portion 179, which rotatably engages an internally threaded aperture 183 in the rearwardly disposed rail grabber 126*a*. The rail grabber 126*a* includes a piston member 185, which slidably and preferably sealingly engages a complimentary opening 186 in the housing cover 175. Rotation of the knob 170 causes the threaded shaft 179 to selectively advance or retract, depending on the direction of rotation, relative to the aperture 183. Since, in use, the rail grabber 126*a* is rigidly secured to rail interface of a weapon, rotation of the windage knob 170 causes movement of the entire unit 100 relative to the weapon. This is in contrast with conventional windage adjustments, which commonly adjust only the position of the laser within the unit.

Figure 12:
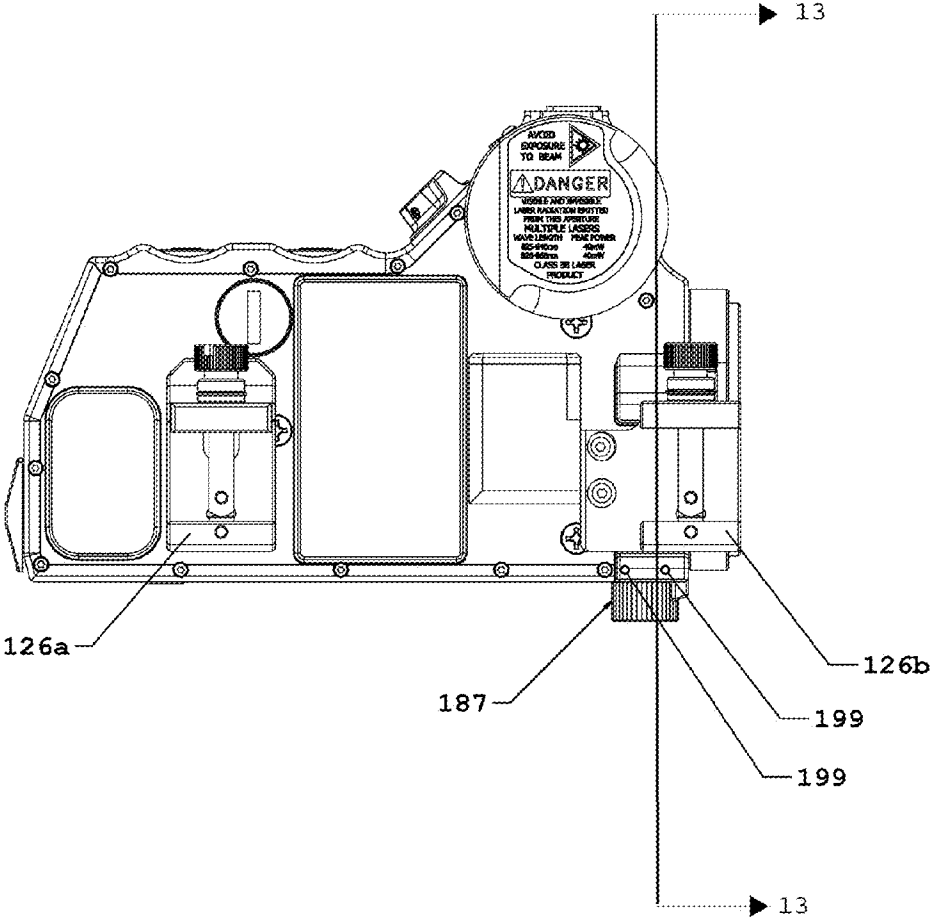
FIG. 12 is a right side elevational view of the embodiment shown in FIG. 1.
Figure 13:
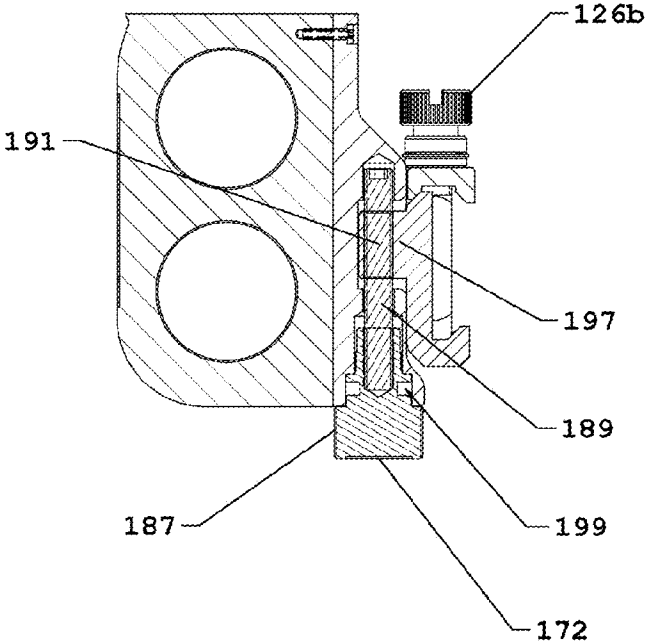
FIG. 13 is a cross-sectional view taken across the line 13-13 in FIG. 12, detailing the elevation adjustment mechanism of the embodiment shown in FIG. 1.
Figure 14:
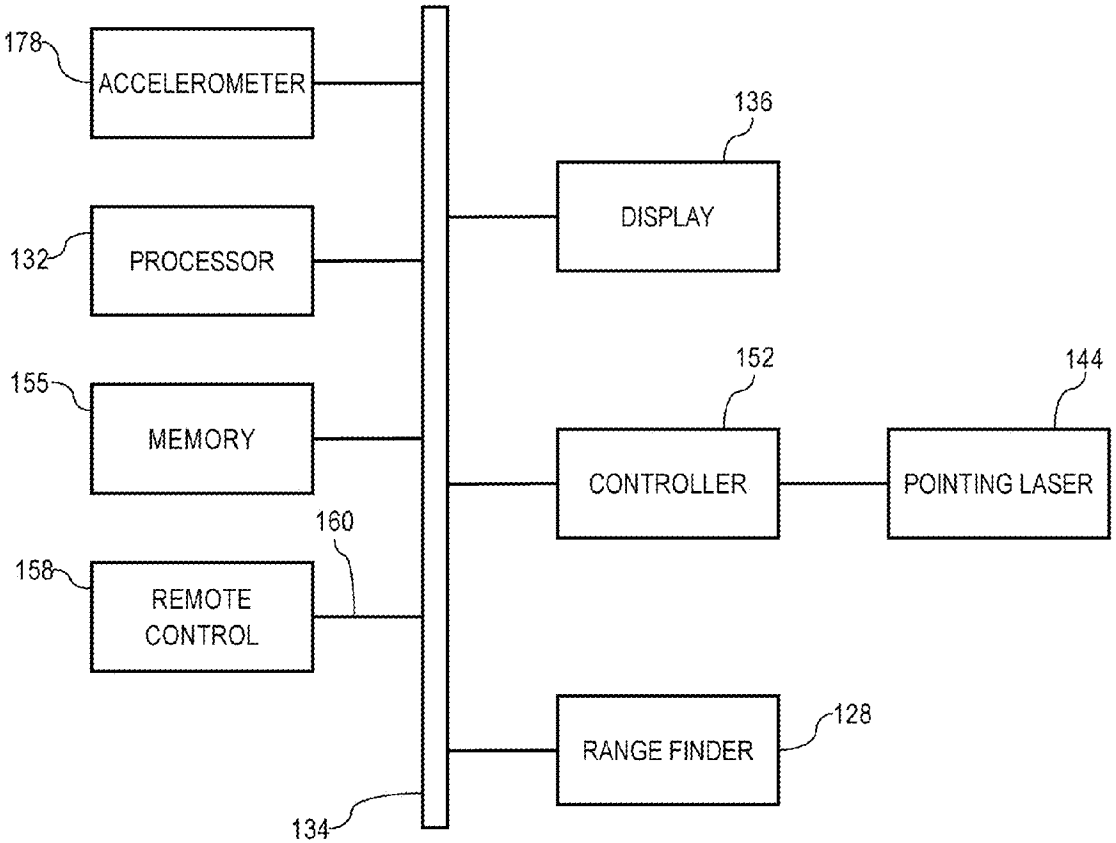
FIG. 14 is a functional block diagram of an exemplary processing system of the sight units herein.

As best seen in FIG. 13, the elevation knob 172 includes a manually rotatable knob portion or head portion 187 and a threaded rod portion 189, which rotatably engages an internally threaded aperture 191 formed in a tongue portion 197 which is part of or rigidly attached to the forward rail grabber 126*b*. Cross pins 199 lock the knob 187 in place after the threaded shaft is screwed into place. Rotation of the knob 172 causes the rail grabber 126*b* to selectively move up or down (in the orientation shown in FIG. 12), depending on the direction of rotation. Since, in use, the rail grabber 126*b* is rigidly secured to rail interface of a weapon, rotation of the elevation knob 172 causes movement of the entire unit 100 relative to the weapon. This is in contrast with conventional elevation adjustments, which commonly adjust only the position of the laser within the unit.

During a bore sighting operation, as the elevation knob 172 is rotated, the elevation angle of the device is canted up and down as the vertical position of the rear of the device is held stationary with the rear rail grabber 126*a*. Likewise, as the windage knob 170 is rotated, the windage angle of the entire device is canted side-to-side as the horizontal position of the front of the device is held stationary with the front rail grabber 126*b*. In a preferred manner of operation, a rough alignment is performed with the rail grabbers 126*a*, 126*b* thumbnuts "finger tight" and a final adjustment is made with the rail grabber nuts 126*a*, 126*b* firmly secured.

In an exemplary mode of operation, the user powers on the unit 100 by rotating the rotary switch 156 to a desired position, which also selects which of the pointing lasers 148, 150 will be actuated by the button 159*a* or 159*b* and, for embodiments wherein a power selection option is provided, selects the power setting for the selected pointing laser. An indication that the unit has been powered on may be shown on the display, for example, by displaying three dashes, horizontal lines, a single dot or a text version of the selection on the display 136. In the preferred embodiment, the angular orientation of the pointing laser assembly relative to the axis of the range finder laser 130 is determined and, if it is not at the zero position, it is automatically returned to the zero position.

The button 159*a* or 159*b* may operate as a toggle switch to toggle the selected one of the pointing lasers 148, 150 on and off or, alternatively, the button 159*a* or 159*b* may function as a momentary contact switch, e.g., to activate the selected pointing laser when the switch is depressed and to deactuate the selected pointing laser when the switch is released.

In a preferred embodiment, the time of the button press or button down events for the button 159*a* or 159*b* are monitored by the processor 132. If the time of a button down event is less than some predetermined value, such as one-half second, the switch 159*a* or 159*b* functions as a momentary contact switch, actuating the laser only when the button depressed and deactivating the laser when the button is released. If the user holds the button down for a period of time that is greater than the preselected threshold, then the button 159*a* or 159*b* will function as a toggle switch and the pointing laser will remain on after the button is released. The user may then press the button 159*a* or 159*b* again to deactivate the pointing laser.

The range finder 128 is actuated by depressing the button 161*a* or 161*b*. Preferably, the state of the button switch 161*a* or 161*b* is monitored and the range finder is not actuated until the button switch 161*a* or 161*b* is held down for some first preselected period of time, e.g., one-half second, before being released. Upon actuation of the range finder, the distance to the target is determined and displayed on the display 136.

The user then has the ability to accept the displayed distance by holding the button 161*a* or 161*b* for some second preselected period of time, e.g., for two seconds. Alternatively, if the user does not want to accept the displayed range, the button 161*a* or 161*b* is depressed for a period of time that is less than the second preselected period of time, at which point the range finding process may be repeated. This gives the operator an opportunity to confirm that the distance calculated by the range finder 128 is consistent with a distance estimate of the operator and, if necessary, to perform the range finding operation again. The calculated distance may be the actual distance, or, alternatively, may be an effective ballistics distance. The use of the effective ballistics distance is advantageous when there is an elevation difference between the user and the target and the user intends to manually rotate the laser assembly to a desired position as described above, and/or to operate in a covert or silent mode negating motor operation, which will be described in greater detail below.

If the user accepts the displayed range, the distance calculated by the range finder function is used by a ballistics computer functionality or module of the processor 132 to calculate the appropriate angle of trajectory of the firearm or artillery relative to the line of sight between the user and the target. The ballistics computation is made based on the trajectory data for the firearm or artillery with which the unit 100 is being used. In certain embodiments, the trajectory data for the ballistics computer functionality may be provided for a particular type of firearm or artillery. Alternatively, trajectory data may be provided for a plurality of firearms or artilleries, for example stored in the memory 155 of, or coupled to, the processor 132. For example, where trajectory data for a plurality of firearms or artilleries is provided, a means for selecting the firearm or artillery with which the unit 100 may be provided. For example, a dedicated switch may be provided. Alternatively, the type of firearm or artillery may be selected using the switch 156 and/or remote control unit 158. For example, the switch 156 may include a firearm selection position, at which point the buttons 159*a* or 159*b* and/or 161*a* or 161*b* may be used to select the firearm or artillery type, with a visual indication of the selected firearm or artillery type being provided on the display 136. The trajectory data for a desired one or more firearms or artilleries may be loaded from a computer based information handling system via the data port 165.

The ballistics computation may be made based on the distance to the target and, optionally, other factors, such as barometric pressure, temperature, humidity, and so forth as would be understood by persons skilled in the art. The ballistics computation may also take into account the vertical displacement of the pointing lasers 148, 150, depending on which pointing laser is selected. In a preferred embodiment, barometric pressure, temperature, and humidity sensors may be provided on the unit and coupled to the processor 132 via the data bus 134.

Once the trajectory is calculated, the processor 132 operates the controller 152 to rotate the pointing laser assembly 144 so that the relative angle between the path of the selected one of the lasers 148 and 150 and thus the bore of the barrel of the firearm or artillery are such that aligning the operative one of the lasers 148 and 150 with the target will cause the firearm or artillery to be positioned at the proper angle for firing the grenade, shell, rocket, mortar round, bullet, or other projectile or munitions type based on the trajectory data, distance to the target, and such other optional ballistics factors such as those described herein. Also, when the displayed range is accepted by the operator, an anti-cant indicator 178 is activated to assist the user in maintaining the firearm or artillery 117 in a substantially horizontal position relative to the optical axis of the pointing laser sight assembly when aligning the pointing laser on the target and firing the round.

Once the pointing laser is aligned with the target and the shot is fired (or if it is otherwise desired to reset the unit), the user may reset the unit by depressing the engage button 193*a* or 193*b* (and preferably by holding it for some predetermined period of time such as one-half second) at which point the display screen resets (e.g., displays the three-horizontal pattern or other indicia to indicate that the unit is powered on) and returns the laser assembly to the zero position.

In certain embodiments, the processing unit 132 calculates the distance and displays the actual distance on the display unit 136. Alternatively, the user may have the option of displaying the effective "ballistics distance" which takes into account any difference in elevation between the user and the target. The inclination along the line of sight between the operator and the target may be determined using an onboard accelerometer or inclinometer 133, which may be a two-axis accelerometer for sensing inclination of the unit 100 along the front-to-back axis of the unit for calculating the ballistics distance and along the side-to-side axis of the unit for use with the cant detection function of the unit 100. The accelerometer 133 is mounted to a secured printed circuit board within the housing 112.

In a further aspect, in certain embodiments, a manual override capability is provided. The operator may manually rotate the knob 146 until the display shows a desired a particular distance (e.g., a calculated or effective ballistics distance to the target as determined using the laser range finding function of the unit 100, or, as determined using an alternate distance estimation or calculation technique). When the display shows the desired distance responsive to manual rotation of the knob 146, the barrel of the firearm will be at an angle relative to the sight so as to provide an appropriate trajectory when the sight is directed to the target. In still further embodiment, a manually-adjustable-only unit is contemplated wherein the motor for adjusting the degree of rotation between the barrel of the attached firearm and the sight is omitted and adjustment of the sight is performed by manual rotation of the knob 146 until the distance appearing on the display 136 matches the calculated distance or effective ballistics distance as calculated, e.g., using the range finder function of the unit 100 or via alternative distance calculation or estimation technique).

The anti-cant indicator 178 includes a sensor, such as the accelerometer 133 to determine the degree side-to-side of rotation of the unit 100 and provide a visual indication when the unit is appropriately positioned, e.g., substantially horizontal relative to the horizon. In the depicted embodiment, a horizontal array of light-emitting diodes (LEDs) 180*a*, 180*b*, 182*a*, 182*b*, and 184 are provided to provide a visual indication of the degree of cant. For example, one of the outermost LEDs 180*a* and 180*b* may be actuated by the processor when the degree of cant to the left and right, respectively, is greater than some first preselected cant angle, e.g., 5 degrees. One of the intermediate set of LEDs 182*a* and 182*b* may be actuated when the cant angle, to the left and right respectively, is between the first preselected cant angle and a second preselected cant angle, e.g., between 2.5 degrees and 5 degrees. The central LED 184 is actuated when the cant angle is less than the first preselected cant angle, e.g., less than 2.5 degrees, indicating that the unit is in proper position for firing. The LEDs 180-184 may also be color coded, for example, the LEDs 180*a* and 180*b* may be red, LEDs 182*a* and 182*b* may be yellow, and LED 184 may be green, with green indicating the proper position for firing and with yellow and red representing increasing degrees of cant.

In some instances, it may be undesirable to use the pointing lasers 148, 150 to sight onto the target. For example, the laser beam emitted by the lasers 148 and 150 may be visible to others, thereby revealing the position of the operator and potentially compromising the operator's safety. Also, the user, in aligning the pointing laser sight 148, 150 with the target may have difficulty seeing the laser under bright light, e.g., daylight, conditions.

In the depicted preferred embodiment, the knob 146 of the laser pointing assembly 144 includes an alternative sighting device 192. In this manner, the alternative sight 192 may be sighted onto the selected target instead of the pointing laser sight to set the trajectory angle of the firearm or artillery. While it is contemplated that the auxiliary sight could be a secondary laser sight, the present development can advantageously employ an alternative sight that does not transmit a beam that can potentially reveal the user's position, and/or which can be more readily aligned with the target in daylight or other bright light conditions. Most preferably, the auxiliary sight 192 is a reflex sight.

In the depicted embodiment, the optical sight bracket 188 includes a plate 190 which is adapted to receive the reflex sight 192. The reflex sight 192 may be a commercially available reflex or red dot sight, e.g., which are commercially available from JPOINT, PRIDEFOWLER, DOCTER, and others. The adapter plate 190 may have features such as protrusions, screw holes, etc. (not shown), which are complimentary with the engaging surface of the reflex sight 192 and/or the optical sight bracket 188. In this manner, the laser assembly 144 may be adapted for use with a particular desired sight by providing a complimentary adapter plate 190. Alternatively, the reflex sight could be integrally formed with the laser assembly 144.

The depicted reflex sight 192 includes a reticle laser assembly (not shown) having a laser or LED that focuses a dot (or other reticle shape) onto a partially reflective lens 198, to visually superimpose the dot on the target when viewed by the user through the lens 198. The reticle laser (not shown) of the reflex sight 192 will generally include a dedicated power supply, such as a lithium battery. However, an electrical coupling between the reflex sight 192 and the power supply 166 of the unit 100 is also contemplated.

In operation, the user may elect to employ the reflex sight 192 instead of the pointing lasers 148, 150. In operation, the user actuates the laser rangefinder to calculate the distance between the operator and the target. If accepted by the user as detailed above, the processor 132 then uses the distance to calculate the appropriate angle between the line of sight between the operator and the target and the barrel of the firearm or artillery and rotates the knob 146 carrying the reflex sight to this angle. The operator may then visually align the dot of the reflex sight 192 on the target when viewed through the lens 198. When the reticle of the reflex sight 192 is visually superimposed on the target as viewed through the lens 198, the firearm or artillery will be aligned to provide an appropriate trajectory for the calculated distance and other optional ballistics computation factors.

Although the preferred embodiments herein show a reflex sight 192, it will be recognized that any other type of alternative sight may also be used, such as iron sights, a telescopic sight (e.g., a 2× or 3× optical sight), etc., although it is preferred to use a reflex or other sight which compensates for parallax which occurs when the user's head moves in relation to the sight. An additional attachment bracket 200 containing a Picatinny rail section may be provided to facilitate an alternative sight configuration. Alternatively, the reflex sight 192 could be replaced with a secondary laser sight.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A combined range finder and sighting apparatus for a firearm having a barrel having an axis, said combined range finder and sighting apparatus comprising:

an optical range finder for calculating a distance to a selected target, said optical range finder including an optical emitter for sending an optical signal to the selected target and an optical detector for detecting the signal reflected from the selected target;

a sight assembly rotatably mounted on said optical range finder;

a computer readable memory encoded with executable instructions;

a processor coupled to the computer readable memory, said processor configured to, upon execution of the executable instructions, to calculate a trajectory angle of the firearm based on the calculated distance to the selected target so that the firearm will launch a projectile a distance that corresponds to a calculated distance to the selected target;

a controller coupled to said sight assembly and said processor; and said processor configured to, upon execution of the executable instructions, to operate said controller to rotate the sight assembly relative to the axis of the barrel of the firearm, such that the barrel of the firearm is aligned with the trajectory angle when the sight assembly is aligned with the selected target.

2. The apparatus of claim 1, wherein said sight assembly includes one or both of:

a laser sight including at least one pointing laser for selectively pointing a laser spot at the selected target; and an auxiliary sight selected from a mechanical sight and an optical sight.

3. The apparatus of claim 2, wherein the auxiliary sight is selected from a reflex sight and a telescopic sight.

4. The apparatus of claim 2, wherein an optical axis of the auxiliary sight is substantially horizontally aligned with an optical axis of the laser sight.

5. The apparatus of claim 2, wherein an optical axis of the auxiliary sight is substantially vertically offset with respect to an optical axis of the laser sight.

6. The apparatus of claim 1, further comprising:

said laser sight including a visible pointing laser and an infrared pointing laser.

7. The apparatus of claim 1, further comprising a rail interface member for attaching said apparatus to a firearm.

8. The apparatus of claim 1, further comprising a rail interface member for attaching said apparatus directly to a firearm.

9. The apparatus of claim 1, further comprising a display for displaying a numerical indication of the distance to the selected target.

10. The apparatus of claim 9, wherein the numerical indication of the distance to the selected target is selected from one or both of an actual distance to the selected target and an effective ballistic distance to the selected target.

11. The apparatus of claim 1, further comprising:

a housing having a plurality of distance indicia thereon; and said sight assembly being manually rotatable with respect to said optical range finder, said sight assembly including a pointer, wherein the firearm will launch a projectile at a trajectory which corresponds to a distance indicated by a selected one of said distance indicia that is aligned with said pointer when the sight assembly is aligned with the selected target.

12. The apparatus of claim 1, further comprising:

a remote control unit for selectively operating said sight assembly and said optical rangefinder.

13. The apparatus of claim 1, further comprising:

a windage adjustment and an elevation adjustment for boresighting said sight assembly to the firearm.

14. The apparatus of claim 1, further comprising:

an anti-cant indicator for providing a visual indication of the degree of rotation of said apparatus about an optical axis of said sight assembly.

15. The apparatus of claim 1, wherein the firearm is a grenade launcher.

16. The apparatus of claim 1, further comprising:

said computer readable memory storing trajectory data associated with a plurality of firearm types for use by the processor in calculating the trajectory angle; and a user interface allowing selection of a selected one of the firearm types to be used by the processor in calculating the trajectory angle.

17. A method of aligning a barrel of a firearm with a trajectory angle relative to a line of sight to a selected target so that the firearm will launch a projectile a distance that corresponds to a calculated distance to the selected target, said method comprising:

using an optical range finder to determine a calculated distance to the selected target, said optical range finder including an optical emitter for sending an optical signal to the selected target and an optical detector for detecting the signal reflected from the selected target;

calculating, using a computer-based processor, the trajectory angle based on the calculated distance; and automatically, using the computer-based processor, rotating a sight rotatably mounted on said optical range finder so that the barrel of the firearm is aligned with the trajectory angle when the sight is directed toward the selected target.

18. The method of claim 17, further comprising:

providing trajectory data associated with a plurality of firearm types for use by the computer based processor in calculating the trajectory angle;

receiving user input to select one of a selected one of the firearm types to be used by the processor in calculating the trajectory angle; and calculating, using the computer based processor, the trajectory angle using the trajectory data associated with the selected one of the firearm types.

19. A method of manually aligning a barrel of a firearm with a trajectory angle relative to a line of sight to a selected target so that the firearm will launch a projectile a distance that corresponds to a calculated distance to the selected target, said method comprising:

using an optical range finder to determine a calculated distance to the selected target, said optical range finder including an optical emitter for sending an optical signal to the selected target and an optical detector for detecting the signal reflected from the selected target;

calculating, using a computer based processor, the trajectory angle based on the calculated distance;

displaying in human viewable form the calculated distance; and displaying in human viewable form in response to manual rotation of a sight rotatably mounted on said optical range finder a ballistics distance corresponding to a degree of rotation of said sight with respect to said optical range finder so that the barrel of the firearm is aligned with the trajectory angle when the ballistics distance displayed is equal to the calculated distance displayed and the sight is directed toward the selected target.

20. The method of claim 19, further comprising:

providing trajectory data associated with a plurality of firearm types for use by the computer based processor in calculating the trajectory angle;

receiving user input to select one of a selected one of the firearm types to be used by the processor in calculating the trajectory angle; and calculating, using the computer based processor, the trajectory angle using the trajectory data associated with the selected one of the firearm types.

* * * * *